US011795951B2

(12) United States Patent
Ye et al.

(10) Patent No.: US 11,795,951 B2
(45) Date of Patent: Oct. 24, 2023

(54) THRUST RUNNER FOR ABRASION RESISTANT BEARING OF CENTRIFUGAL PUMP

(71) Applicant: Baker Hughes Oilfield Operations LLC, Houston, TX (US)

(72) Inventors: Zheng Ye, Claremore, OK (US); Ignacio Martinez, Tulsa, OK (US); Risa Rutter, Claremore, OK (US); Mark Paquette, Claremore, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 30 days.

(21) Appl. No.: 17/307,934

(22) Filed: May 4, 2021

(65) Prior Publication Data

US 2021/0348613 A1 Nov. 11, 2021

Related U.S. Application Data

(60) Provisional application No. 63/020,913, filed on May 6, 2020.

(51) Int. Cl.
*F04D 13/10* (2006.01)
*F04D 29/44* (2006.01)
(Continued)

(52) U.S. Cl.
CPC ..... *F04D 13/10* (2013.01); *F04D 1/06* (2013.01); *F04D 29/22* (2013.01); *F04D 29/445* (2013.01)

(58) Field of Classification Search
CPC .. F04D 13/10; F04D 29/0413; F04D 29/0473; F04D 1/06; F04D 13/08;
(Continued)

(56) References Cited

U.S. PATENT DOCUMENTS 4,781,531 A 10/1988 James
5,722,812 A 3/1998 Knox et al.
(Continued)

FOREIGN PATENT DOCUMENTS

CN 206221299 U 6/2017
WO 2019027543 A1 2/2019

OTHER PUBLICATIONS

International Search Report and Written Opinion for PCT Application No. PCT/US2021/031052 dated Aug. 24, 2021.

*Primary Examiner* — Dominick L Plakkoottam
(74) *Attorney, Agent, or Firm* — BRACEWELL LLP; Keith R. Derrington

(57) ABSTRACT

A submersible well pump has a rotatable drive shaft extending through pump stages. Each of the stages has a diffuser, an impeller and a bushing fixed for non-rotation in the diffuser. A thrust member has a lower side in sliding rotating engagement with the upward facing surface of the bushing. The bushing and the thrust member are of a harder material than the diffuser and the impeller. A drive member of a softer material than the thrust member is in engagement with the thrust member and has a drive member bore through which the shaft extends. A key extends through the shaft groove, the impeller groove and the drive member groove to cause the impeller and thrust member to rotate with the shaft.

20 Claims, 5 Drawing Sheets

(51) Int. Cl.
*F04D 1/06* (2006.01)
*F04D 29/22* (2006.01)

(58) Field of Classification Search
CPC ..... F04D 29/628; F04D 29/12; F04D 1/04; F04D 29/026; F04D 29/04; F04D 29/041; F04D 29/046; F04D 29/0476; F04D 29/445; F04D 29/448; F04D 3/00; F16C 2360/44; F16C 2300/34; F16C 33/08; F16C 35/02; F16C 35/10; E21B 4/003; F05D 2260/36
See application file for complete search history.

(56) References Cited

U.S. PATENT DOCUMENTS

| | | | | |
|---|---|---|---|---|
| 9,353,752 | B2 * | 5/2016 | Tetzlaff | F04D 13/10 |
| 10,145,380 | B1 * | 12/2018 | Davis | F04D 29/041 |
| 10,344,866 | B2 | 7/2019 | Ye et al. | |
| 11,460,038 | B2 * | 10/2022 | Beck | F04D 13/10 |
| 2006/0204359 | A1 * | 9/2006 | Semple | F04D 29/047 415/170.1 |
| 2011/0027077 | A1 | 2/2011 | Brunner et al. | |
| 2015/0226219 | A1 * | 8/2015 | Johnson | F04D 1/06 417/423.3 |
| 2016/0115998 | A1 * | 4/2016 | Jayaram | F04D 29/448 384/296 |
| 2017/0241428 | A1 * | 8/2017 | Ye | F04D 29/106 |
| 2017/0350399 | A1 | 12/2017 | Eslinger | |
| 2018/0291907 | A1 * | 10/2018 | Ye | F04D 29/026 |
| 2018/0291917 | A1 * | 10/2018 | Webster | F04D 13/10 |
| 2019/0368511 | A1 | 12/2019 | Williams et al. | |
| 2020/0080562 | A1 * | 3/2020 | Knapp | F04D 29/628 |

* cited by examiner

THRUST RUNNER FOR ABRASION RESISTANT BEARING OF CENTRIFUGAL PUMP

CROSS-REFERENCE TO RELATED APPLICATION

This application claims priority to provisional application Ser. No. 63/020,913, filed May 6, 2020.

FIELD OF THE DISCLOSURE

This disclosure relates in general to electrical submersible well pumps and in particular to a centrifugal pump having impeller and diffuser stages with abrasion resistant bearings, each of the bearings having a thrust runner configured to reduce the entry of sand particles between thrust runner and the drive shaft.

BACKGROUND

Electrical submersible pump assemblies (ESP) are widely used to pump oil production wells. A typical ESP has a rotary pump driven by an electrical motor. A seal section located between the pump and the motor seals dielectric motor lubricant from the well fluid. The seal section may have components to reduce the differential between the well fluid pressure on the exterior of the motor and the lubricant pressure within the motor. A drive shaft, normally in several sections, extends from the motor through the seal section and into the pump for driving the pump. The pump may be a centrifugal pump having a large number of stages, each stage having an impeller and diffuser.

During operation, the impellers create thrust, which can be both in downward and upward directions. The impellers transmit the thrust in various manners to the diffusers. Some pumps are particularly used in abrasive fluid environments. In those pumps, a thrust runner is coupled to the shaft to receive down thrust from one or more impellers. A key fits within an axially extending groove in the inner diameter of the thrust runner and an axially extending groove on the outer diameter of the drive shaft. A bushing secured into a receptacle in the diffuser receives the down thrust and transfers the down thrust to the diffuser. The thrust runner and the bushing may be formed of an abrasion resistant material, such as tungsten carbide, that is harder than the material of the shaft and the diffuser. The bushing is commonly installed in the receptacle with a press fit.

In wells with extensive sand or well fluid particulate production, wear of the key and keyway groove in the shaft is a common problem. The sand particles and other abrasives may be smaller than the clearances between the key and the axially extending mating grooves. These particulates can be trapped and cause fretting wear due to torsional vibration. The drive shaft and key are generally of softer material then the material of the thrust runner, causing the fretting wear to be more severe in the key and the drive shaft. When the key cannot continue to hold the torque between the drive shaft and the thrust runner, it may shear off. The wear then translates from fretting into abrasion between the drive shaft and the thrust runner, which accelerates the material removal from the drive shaft. Finally, mechanical shock may break the thrust runner, or the reduced shaft diameter may no longer be able to deliver the torque required.

SUMMARY

A submersible well pump comprises a rotatable drive shaft extending along a longitudinal axis of the pump, the shaft having a shaft groove. The pump has a plurality of pump stages, each of the stages comprising a diffuser, an impeller having an axially extending impeller groove, and a bushing fixed for non-rotation in the diffuser. The bushing has an upward facing surface. A thrust member positioned to receive down thrust from the impeller has a lower side in sliding rotating engagement with the upward facing surface of the bushing. The bushing and the thrust member are of a harder material than the diffuser and the impeller. A drive member of a softer material than the material of the thrust member is in engagement with the thrust member. The drive member has a drive member bore through which the shaft extends. The drive member bore has an axially extending drive member groove. A key extends through the shaft groove, the impeller groove and the drive member groove to cause the impeller and thrust member to rotate with the shaft.

In one embodiment, the thrust member is an annular disk having a central aperture. The drive member is an insert sleeve secured in the central aperture of the thrust member. The insert sleeve may be rigidly secured to the thrust member in the central aperture of the thrust member. A lower end of the drive member may be in sliding engagement with the bushing.

In another embodiment, the drive member has an upper flange that overlies an upper surface of the thrust member.

In a third embodiment, the drive member comprises an annular disk. The thrust member comprises at least one pad secured to a lower side of the drive member. More particularly, the drive member may have a plurality of recesses spaced around a lower side of the drive member in an array encircling the drive member bore. The at least one pad comprises a plurality of pads, each secured within one of the recesses in the lower side of the drive member.

In a fourth embodiment, the drive member comprises a tubular member joining and extending downward from a lower side of the impeller. The drive member has an outer surface containing a plurality of drive surfaces. The thrust member has a central opening that slides over the drive member. The central opening contains a plurality of drive surfaces in engagement with the drive surfaces of the drive member.

More particularly, the tubular member may be an extended portion of a hub of the impeller. The hub has an outer surface containing a plurality of outward facing drive flats. The thrust member has a central opening containing a plurality of drive flats that engage the drive flats of the drive member. In the embodiment shown, the hub has a downward facing shoulder. The thrust member has an upward facing shoulder in abutment with the downward facing shoulder to transfer down thrust from the impeller to the bushing.

Figure 1:
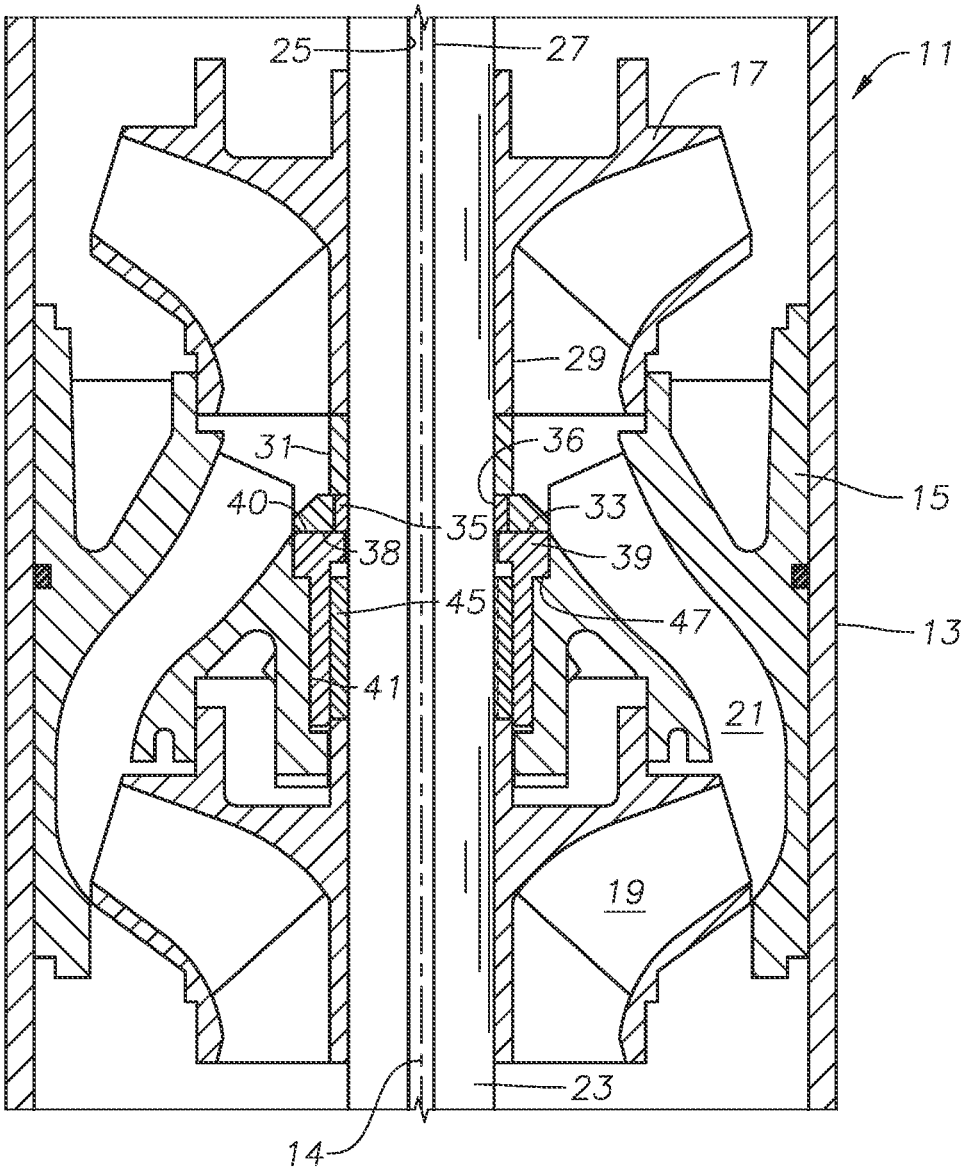
FIG. 1 is an axial sectional view of a stage of electrical submersible well pump, illustrating a thrust runner in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. The terms "upward", "downward" and the like are used only for convenience, as the pump may operate in other orientations than vertical.

Referring to FIG. 1, pump 11 has a tubular housing 13 with a central bore having a longitudinal axis 14. Pump 11 is a centrifugal type, having a large number of stages (only one complete stage shown). Each stage has a diffuser 15 that is fixed in a stack in housing 13 with other diffusers (not shown) so as to be non-rotatable in housing 13. A rotating impeller 17 (two shown) engages each diffuser 15. Each impeller 17 has impeller passages 17 that extend upward and outward around axis 14 for discharging well fluid to diffuser passages 21 of the next upward diffuser.

A drive shaft 23 extends through housing 13 along axis 14 and through openings in diffusers 15 and impellers 17. Two axially extending grooves 25 (only one shown) extend along the outer surface of shaft 23. A key 27 fits in each groove 25 for rotating impellers 17 with shaft 23.

Impeller 17 has a tubular hub 29 with a central opening through which shaft 23 extends. The discharge of well fluid from impeller 17 creates down thrust on impeller 17 that transfers from hub 29 through a spacer sleeve 31 in this example to a thrust member 33. Spacer sleeve 31 may be eliminated by lengthening hub 29 so that it is in direct contact with thrust member 33. For the purposes herein, spacer sleeve 31 may be considered to be a part of hub 29.

Figure 2:
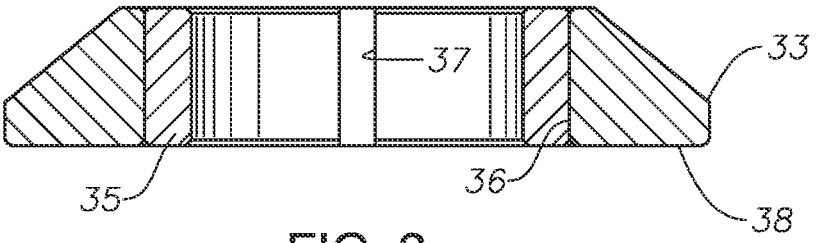
FIG. 2 is an axial sectional view of the thrust runner of FIG. 1, taken along the line 2-2 of FIG. 3 and shown removed from the pump.
Figure 3:
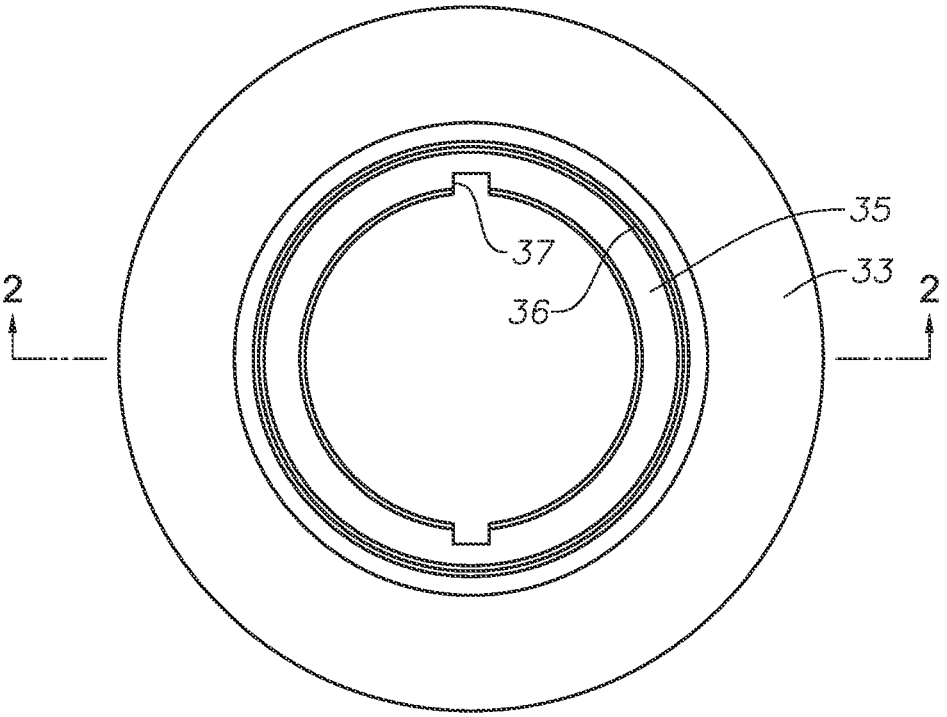
FIG. 3 is a top view of the thrust runner of FIG. 2

Thrust member 33 has a drive member 35 secured to it that causes thrust member 33 to rotate with shaft 23. Referring to FIG. 2, thrust member 33 is an annular disk with a central bore 36. Drive member 35 is an annular member mounted in central bore 36 of thrust member 33 for rotation in unison. Drive member 35 may be secured in central bore 36 by an interference fit or other techniques, such as welding or brazing. Two axial grooves 37 (only one shown in FIG. 2), which also extend through spacer sleeve 31 and impeller hub 29, are engaged by keys 27 (FIG. 1) for rotation in unison. As shown in FIG. 3, the two grooves 37 may be 180 degrees apart from each other for balance. Alternately, only a single key 27 and single groove 37 could be employed.

Referring again to FIG. 1, thrust member 33 has a flat downward facing surface 38 that slides and rotates on an upper surface of a bushing 39 to transfer down thrust. The lower end of drive member 35 may also rotate in sliding engagement with the upper surface of bushing 39. Bushing 39 is mounted for non-rotation in a receptacle 41 in diffuser 15. The engagement between bushing 39 and receptacle 41 may be an interference fit.

A radial bearing sleeve 45 located in bushing 39 has a central opening that receives and rotates radial bearing sleeve 45 with shaft 23. Grooves 37 in drive member 35, impeller hub 29 and spacer sleeve 31 also extends through radial bearing sleeve 45 for receiving keys 27. The outer surface of radial bearing sleeve 45 is cylindrical and in rotating, sliding engagement with the inner surface of bushing 39.

Bushing 39 may have a downward facing shoulder 47 that bears against an upward facing shoulder in receptacle 41. The inner surface of bushing 39 above radial bearing sleeve 45 is not in contact with shaft 23 or keys 27.

Impeller 17, spacer sleeve 31, thrust member 33 and drive member 35 are axially movable a small amount relative to drive shaft 23. During down thrust, at least a portion or all of the lower end of spacer sleeve 31 will be in abutment with the upper side of drive member 35. Also, the lower end of spacer sleeve 31 may have some contact with the upper side of thrust member 33. Down thrust created by each impeller 17 transfers through spacer sleeve 31, drive member 35, thrust member 33, and bushing 39 to one of the diffusers 15. The down thrust passes through the stack of diffusers 15 to housing 13.

Thrust member 33, bushing 39 and radial bearing sleeve 45 are of a material that is harder and more abrasion resistant than the material of diffusers 15 and impellers 17. For example, thrust member 33, bushing 39 and radial bearing sleeve 45 may be formed of tungsten carbide. Diffusers 15 and impellers 17 may be formed of a nickel-based alloy such as Ni-Resist. Also, the materials of thrust member 33, bushing 39 and radial bearing sleeve 45 are harder than the material of drive member 35. Drive member 35 may also be formed of a nickel-based alloy. Keys 27 and shaft 23 are formed of a steel alloy, softer than the hard material of thrust member 33.

The more abrasion resistant material reduces abrasion on thrust member 33, bushing 39 and radial bearing sleeve 45 that may otherwise occur if the well fluid has a significant sand or abrasive particle content. Drive member 35 is less wear resistant than thrust member 33, but it reduces wear on key 27 and shaft 23. Avoiding direct engagement between thrust member 33 and keys 27 and shaft 23 reduces the fretting that otherwise occurs due to sand particulates in the well fluid. Having key grooves 37 in the bore of the softer drive member 35 avoids direct contact of keys 27 and shaft 23 with the harder thrust member 33.

Figure 4:
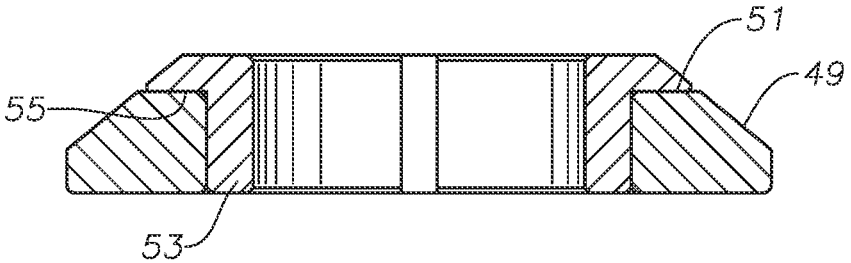
FIG. 4 is an axial sectional view of a second embodiment of the thrust runner of FIG. 1.

FIG. 4 illustrates a second embodiment of a thrust member and drive member. Thrust member 49 has an upper surface 51. Drive member 53 has an external flange 55 that overlies upper surface 51. Drive member 53 may be secured in thrust member 49 by shrink fit or welding or brazing. Spacer sleeve 31 will be in abutment with and rotating with flange 55. Drive member 53 is of a softer material than thrust member 49, as in the first embodiment. Flange 55 prevents any downward slippage of drive member 53 in thrust member 49. In the first embodiment, in the unlikely event that the interference fit between drive member 35 (FIG. 2) and thrust member 33 loosened, axial slippage could occur.

Figure 5:
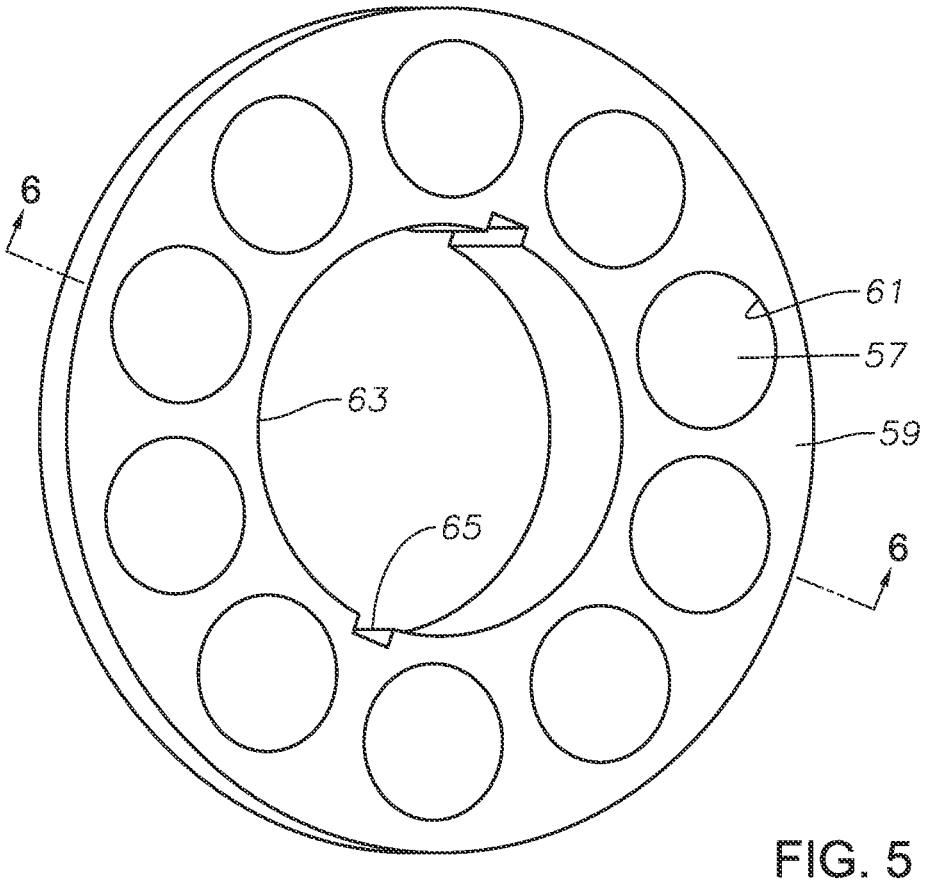
FIG. 5 is a perspective bottom view of a third embodiment of the thrust runner of FIG. 1.
Figure 6:
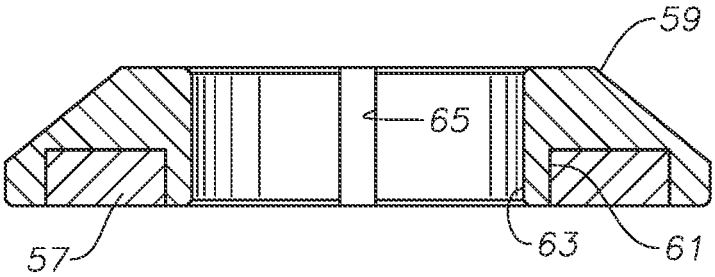
FIG. 6 is an axial sectional view of the thrust runner of FIG. 5, taken along the line 6-6 of FIG. 5.

FIGS. 5 and 6 illustrate a third embodiment. The thrust member comprises a number of thrust pads 57 spaced in a circular array. Thrust pads 57 are cylindrical disks mounted in cylindrical recesses 61 of a drive member 59, such as by shrink fit or welding or brazing. Drive member 59 has a central bore containing a pair of axial grooves 65, each for receiving one of the keys 27 (FIG. 1). As in the other embodiments, drive member 59 is formed of a softer material than thrust pads 57. Thrust pads 57 have flat lower sides that slidingly engage the upper side of bushing 39 (FIG. 1) to transfer down thrust.

Figure 7:
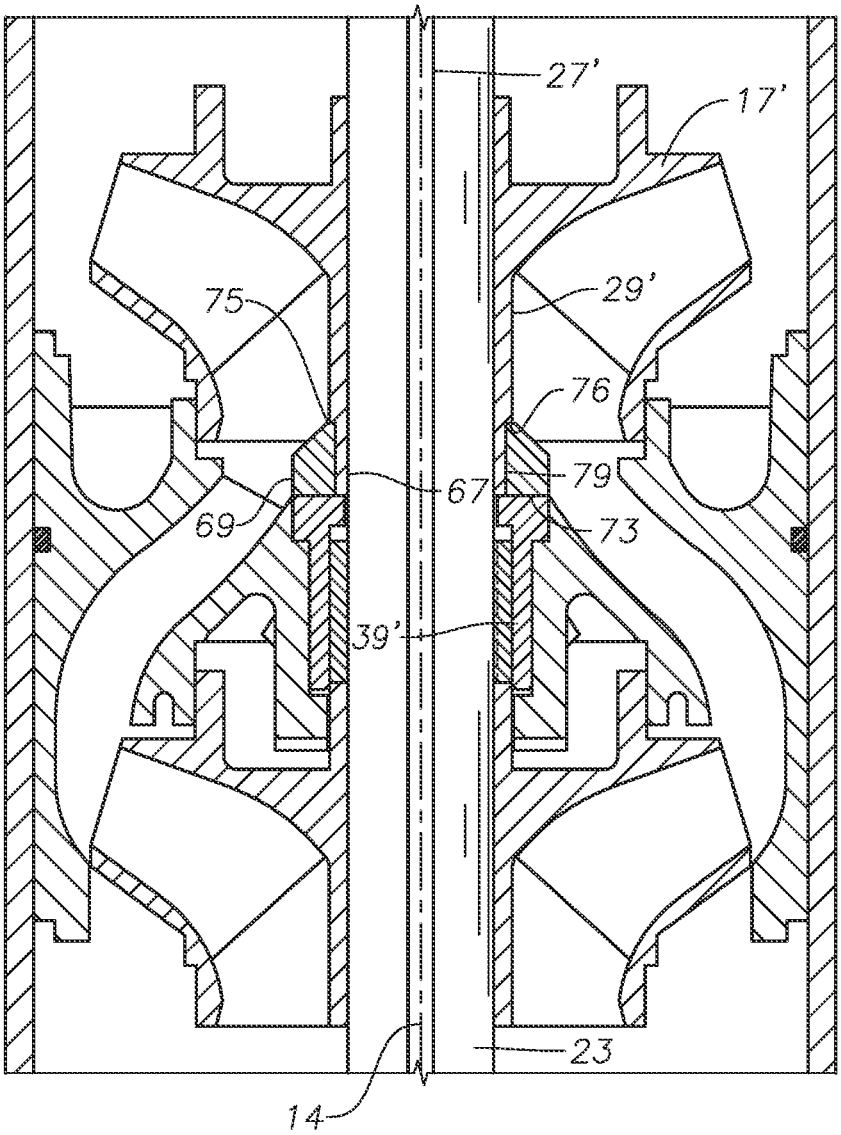
FIG. 7 is an enlarged sectional view of a stage of an electrical submersible well pump, illustrating a fourth embodiment of the thrust runner of FIG. 1.
Figure 8:
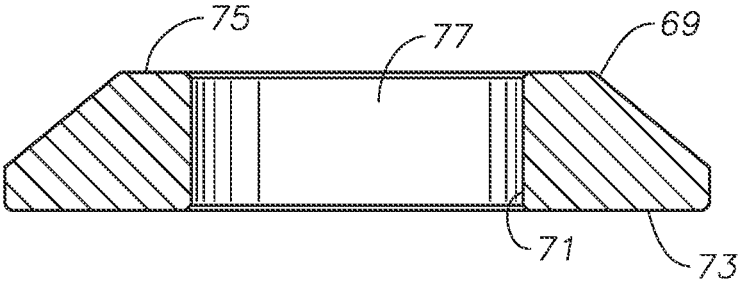
FIG. 8 is an axial sectional view of the thrust runner of FIG. 7, shown removed from the pump.

Referring to FIGS. 7-10, in this fourth embodiment, components that are similar to those in FIG. 1 will not be mentioned again, or if mentioned, the same reference numeral with a prime symbol will be used. Drive member 67 is an extension of impeller hub 29' and is integrally joined to it in this example. As shown in FIG. 8, thrust member 69 has a central opening 71 that receives drive member 67. Thrust member 69 has a downward facing surface 73 that engages in sliding, rotating contact with bushing 39'. Thrust member 69 has an upward facing surface 75 that engages a downward facing shoulder 76 (FIG. 7) at the lower end of hub 29'.

Figure 9:
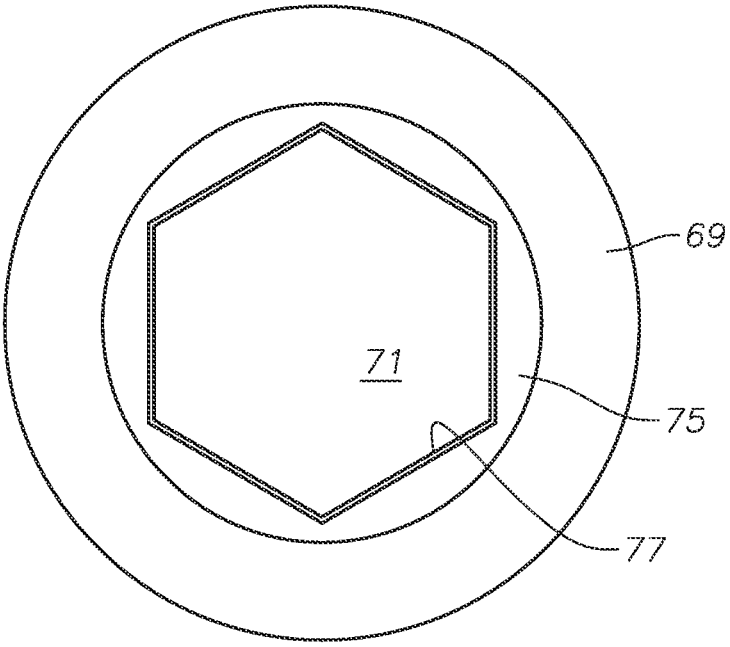
FIG. 9 is a top view of the thrust runner of FIG. 8.
Figure 10:
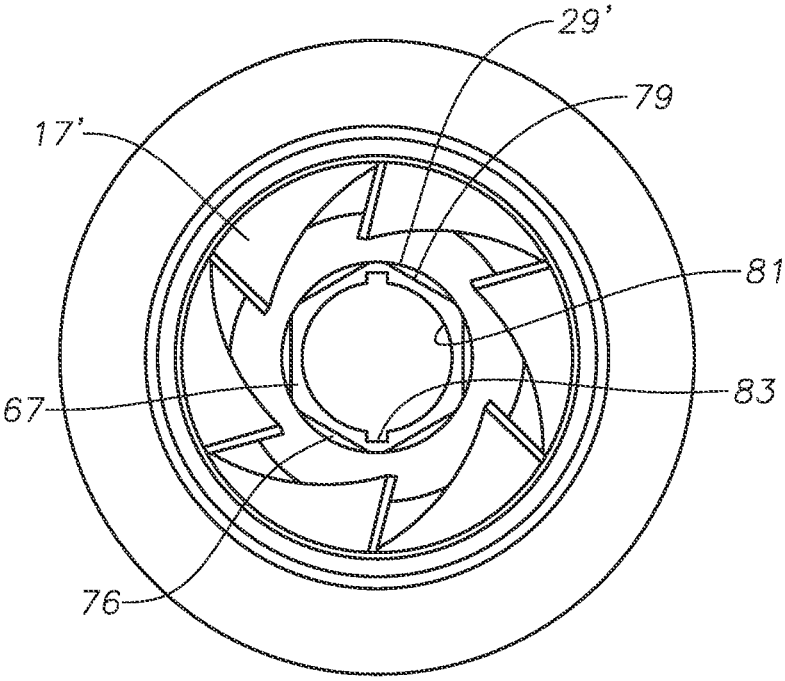
FIG. 10 is a bottom view of the upper impeller shown in FIG. 7 and removed from the pump.

Referring to FIG. 9, thrust member 69 has drive flats 77 in its central opening 71. In this example, there are six drive flats 77 forming a hexagonal pattern similar to a socket for driving a hexagonal nut. As shown in FIG. 10, drive member 67 has external drive flats 79 formed in a hexagonal pattern for engaging thrust member drive flats 77 (FIG. 9). Drive member 67 also has a central bore 81 for receiving shaft 23 (FIG. 1). Grooves 83 extend through bore 81, joining the grooves in impeller hub 29' of impeller 17' for receiving keys 27' (FIG. 7).

As in the other embodiments, drive member 67 is formed of a softer material than thrust member 69. During operation, rotation from impeller hub 29' transfers through drive flats 77, 79 to thrust member 69. Down thrust from impeller 17' passes from impeller hub shoulder 76 to thrust member 69, and from thrust member 69 to non-rotating bushing 39'.

Figure 11:
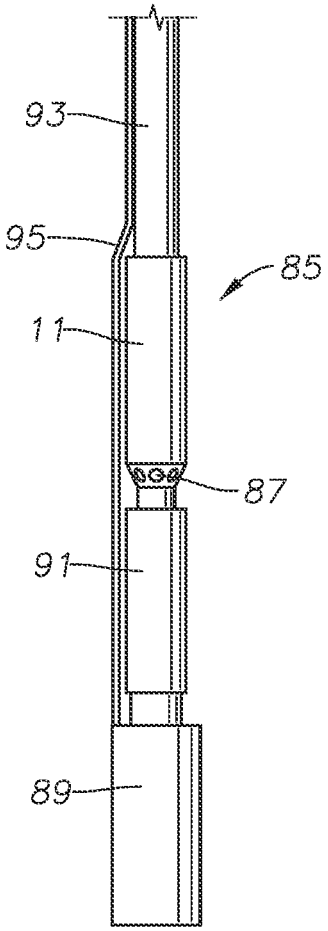
FIG. 11 is a schematic side view of an electrical submersible well pump assembly having a pump in accordance with this disclosure.

FIG. 11 schematically illustrates other components of a typical electrical submersible pump assembly (ESP) 85. Pump 11 has a pump intake 87 for receiving well fluid. A motor 89 drives pump 11. A seal section 91 connects between motor 89 and pump 11. Seal section 91 may have a pressure equalizer, such as a bladder, for reducing a pressure differential between dielectric lubricant in motor 89 and the well fluid. A string of tubing 93 supports ESP 85. A power cable 95 extends down from a wellhead to a receptacle on motor 89 to supply power. A drive shaft assembly (not shown) extends from motor 89 through seal section 91 and couples to pump shaft 23 (FIG. 1) for driving pump 11.

The present invention described herein, therefore, is well adapted to carry out the objects and attain the ends and advantages mentioned, as well as others inherent therein. While a few embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A submersible well pump, comprising:

a rotatable drive shaft extending along a longitudinal axis of the pump, the shaft having a shaft groove;

a plurality of pump stages, each of the stages comprising:

a diffuser;

an impeller having an axially extending impeller groove;

a bushing fixed for non-rotation in the diffuser, the bushing having an upward facing surface;

a thrust member positioned to receive down thrust from the impeller, the thrust member having a lower side in sliding rotating engagement with the upward facing surface of the bushing;

the bushing and the thrust member being of a harder material than the diffuser and the impeller;

a drive member of a softer material than the material of the thrust member, the drive member being in engagement with the thrust member and having a drive member bore through which the shaft extends, the drive member bore having an axially extending drive member groove; and a key extending through the shaft groove, the impeller groove, and the drive member groove to cause the impeller and the drive member to rotate with the shaft, and so that when the drive member rotates, the engagement between the thrust member and drive member causes the thrust member to rotate.

2. The pump according to claim 1, wherein:

an annular space is defined between the shaft and the thrust member, the annular space having an axial length that is substantially an axial length of the thrust member, and wherein the drive member occupies the annular space.

3. The pump according to claim 1, wherein:

the drive member comprises an insert sleeve rigidly secured to the thrust member in the central aperture of the thrust member.

4. The pump according to claim 1, wherein:

the drive member comprises an insert sleeve rigidly secured to the thrust member in the central aperture of the thrust member; and wherein a lower end of the drive member is in sliding engagement with the upward facing surface of the bushing.

5. The pump according to claim 1, wherein:

the thrust member comprises an annular disk having a central aperture;

the drive member comprises an insert sleeve in the in the central aperture of the thrust member; and the drive member has an upper flange that overlies and is in contact with an upper surface of the thrust member.

6. The pump according to claim 1, wherein the thrust member comprises at least one pad secured to a lower side of the drive member.

7. The pump according to claim 1, wherein:

the drive member comprises an annular disk having a lower side containing a plurality of recesses spaced around a lower side of the drive member in an array encircling the drive member bore; and the thrust member comprises a plurality of pads, each secured within one of the recesses in the lower side of the drive member.

8. The pump according to claim 1, wherein:

the drive member comprises a tubular member joining and extending downward from a lower side of the impeller, the drive member having an outer surface containing a plurality of drive surfaces; and the thrust member has a central opening that slides over the drive member, the central opening containing a plurality of drive surfaces in engagement with the drive surfaces of the drive member.

9. The pump according to claim 1, wherein:

the drive member comprises a hub joined to and extending downward from the impeller, the hub having an outer surface containing a plurality of outward facing drive flats; and the thrust member has a central opening containing a plurality of drive flats that engage the drive flats of the drive member.

10. The pump according to claim 1, wherein:

the drive member comprises a hub joined to and extending downward from the impeller, the drive member having an outer surface containing a plurality of outward facing drive flats and a downward facing shoulder;

the thrust member has a central opening containing a plurality of drive flats that engage the drive flats of the drive member to cause rotation of the thrust member; and the thrust member has an upward facing shoulder in abutment with the downward facing shoulder to transfer down thrust from the impeller through the thrust member to the bushing.

11. The pump according to claim 1, wherein the impeller has an impeller hub with a hub bore through which the shaft extends, the hub bore having the axially extending impeller groove;

a plurality of drive member flanks are on an outer surface of the hub below the impeller; and the thrust member has a central aperture that receives the hub, the central aperture having a plurality of thrust member flanks that mate with the drive member flanks for causing rotation of the thrust member with the shaft.

12. A submersible well pump, comprising:

a rotatable drive shaft extending along a longitudinal axis of the pump, the shaft having a shaft groove;

a plurality of pump stages in the pump, each of the stages comprising:

a diffuser;

an impeller having an axially extending impeller groove;

a bushing fixed for non-rotation in the diffuser, the bushing having an upward facing surface;

a thrust member having a central aperture and a lower side in sliding rotating engagement with the upward facing surface of the bushing;

the bushing and the thrust member being of a harder material than the diffuser and the impeller;

a drive sleeve of a softer material than the material of the thrust member, the drive sleeve secured to the thrust member within the central aperture of the thrust member, the drive sleeve having a drive sleeve bore through which the shaft extends, the drive sleeve bore having an axially extending drive sleeve groove, the drive sleeve having an upper end that is abutted by the impeller to transfer down thrust through the drive sleeve and the thrust member to the bushing;

a key in engagement with the shaft groove, the impeller groove and the drive sleeve groove to cause the impeller and the drive sleeve to rotate with the shaft; and an engaging interface between the drive sleeve and the thrust member that causes the thrust member to rotate with rotation of the drive sleeve.

13. The pump according to claim 12, wherein:

the drive sleeve has an upper flange with a lower side that is in abutment with an upper surface of the thrust member.

14. The pump according to claim 12, wherein a lower end of the drive sleeve is flush with the lower side of the thrust member.

15. A submersible well pump, comprising:

a rotatable drive shaft extending along a longitudinal axis of the pump, the shaft having a shaft groove; and a plurality of pump stages, each of the stages comprising:

a diffuser;

an impeller having an axially extending impeller groove;

a bushing fixed for non-rotation in the diffuser and comprising a material harder than the impeller;

a thrust member circumscribing the shaft and positioned axially between the impeller and bushing, and that comprises a material harder than the impeller; and a drive member comprising a material softer than the material of the thrust member, the drive member disposed between and rotationally engaged to both the shaft and thrust member to cause rotation of the thrust member in response to rotation of the shaft.

16. The pump according to claim 15, further comprising a key for transmitting rotational force from the shaft to the drive member, wherein the thrust member is spaced radially from the key, wherein the thrust member has a lower side in sliding rotating engagement with an upward facing surface of the bushing, and wherein the thrust member is rotationally engaged to the drive member by a securement consisting of an interface fit, a brazed connection, a welded connection, and combinations thereof.

17. The pump according to claim 15, wherein a lower axial end of the thrust member terminates above where an upper end of the bushing terminates.

18. The pump according to claim 15, wherein a portion of the bushing has an internal diameter that is circumscribed by an internal diameter of the thrust member.

19. The pump according to claim 15, wherein an annular space is defined between the shaft and thrust member and extends along an axial length of the thrust member.

20. The pump according to claim 19, wherein the drive member occupies substantially all of the annular space.

* * * * *